US006987357B2

(12) United States Patent
Kao et al.

(10) Patent No.: US 6,987,357 B2
(45) **Date of Patent: *Jan. 17, 2006**

(54) DRIVING ELECTRODE STRUCTURE OF PLASMA DISPLAY PANEL

(75) Inventors: Hsu-Pin Kao, Ping Chen (TW); Yuan-Chi Lin, Taoyuan (TW); Ching-Hui Lin, Taoyuan (TW); Kuang-Lang Chen, Chungli (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 21 days.

This patent is subject to a terminal disclaimer.

(21) Appl. No.: 10/750,749

(22) Filed: Jan. 2, 2004

(65) Prior Publication Data

US 2004/0140768 A1 Jul. 22, 2004

Related U.S. Application Data

(63) Continuation of application No. 10/192,380, filed on Jul. 9, 2002, now Pat. No. 6,791,265.

(51) Int. Cl.
*H01J 17/49* (2006.01)

(52) U.S. Cl. ..... 313/582; 313/584

(58) Field of Classification Search ..... 313/582–587, 313/491, 581, 631, 326; 315/169.1, 161.4; 345/60, 43

See application file for complete search history.

(56) References Cited

U.S. PATENT DOCUMENTS 6,373,195 B1 4/2002 Whang et al. ..... 315/169.3
6,522,072 B1 2/2003 Yura et al. ..... 313/582

*Primary Examiner*—Edward J. Glick
*Assistant Examiner*—Elizabeth Keaney
(74) *Attorney, Agent, or Firm*—Thomas, Kayden, Horstemeyer & Risley

(57) ABSTRACT

A driving electrode structure of a plasma display panel is described. The driving electrode structure has a driving electrode located in one luminant cell of each pixel. The driving electrode is formed on a transparent electrode and separated by a distance from the side of the transparent electrode adjacent to the edge of the luminant cells. The driving electrode has two branches coupled to a main electrode or a side electrode at the side of the transparent electrode adjacent to the edge of luminant cells. The driving electrode approximates the discharge center of the luminant cell to improve the driving characteristic.

10 Claims, 3 Drawing Sheets

DRIVING ELECTRODE STRUCTURE OF PLASMA DISPLAY PANEL

CROSS REFERENCE TO RELATED APPLICATION

This is a continuation of application Ser. No. 10/192,380, filed Jul. 9, 2002, now U.S. Pat. No. 6,791,265.

FIELD OF THE INVENTION

The present invention relates to a plasma display panel (PDP), and more particularly to a driving electrode structure having a driving electrode that improves the driving characteristic of the luminant cell.

BACKGROUND OF THE INVENTION

Since the field of multimedia applications is developing quickly, the user has a great demand for entertainment equipment. Conventionally, the cathode ray tube (CRT) display, a type of monitor, is commonly used. However, the cathode ray tube display does not meet the needs of multimedia technology because it has a large volume. Therefore, many flat panel display techniques such as liquid crystal display (LCD), plasma display panel (PDP), and field emission display (FED) have been recently developed. These display techniques can manufacture a thin, light, short and small monitor, and thus these techniques are going to be the mainstream technology for the future. In these techniques, the plasma display panel (PDP) is attracting attention in the field of displays as a full-color display apparatus having a large size display area and is especially popularly utilized in large-size televisions or outdoor display panels. This is because of its capability of a high quality display resulting from the fact that it is of a self-light emitting type with a wide angle of visibility and high speed of response as well as being suited to upsizing due to a simple manufacturing process.

A color PDP is a display in which ultraviolet rays are produced by gas discharge to excite phosphorus so that visible lights are emitted therefrom to perform a display operation. Depending upon a discharge mode, the color PDP is classified as an alternating current (AC) or a direct current (DC) type. In the AC-type PDP, an electrode is covered with a protective layer. The AC-type PDP has such characteristics that it inherently has a long life and a high brightness. Therefore, the AC-type PDP is generally superior to the DC-type PDP in luminance, luminous efficiency and lifetime. Generally, a 3-electrode type PDP including a common electrode, a scan electrode and an address electrode is employed in the AC-type PDP. The 3-electrode type is directed to a surface discharge type and is switched or sustained based on a voltage applied to the address electrode installed at a lateral surface of a discharge cell.

FIG. 1 is a schematic plan view of a conventional plasma display panel in accordance with the prior art. Several pairs of conductive electrodes 10 are parallel arranged, and each pair of the conductive electrodes 10, including a common electrode and a scan electrode, is symmetrically disposed. A plurality of parallel barrier ribs 20 is disposed with a direction perpendicular to the conductive electrodes 10. By the arrangement of the conductive electrodes 10 and barrier ribs 20, a plurality of luminant cells 30 is array scaled therein.

The common and scan electrodes formed on an image display side substrate are generally formed of a transparent electrode 14 made of a glass material for implementing a certain transmittivity of visual ray. A non-transparent electrode 12 having a small width, generally referred as a bus electrode, is used integrally with respect to the transparent electrode 14. The transparent electrode material is a semiconductor typically formed of ITO (e.g., a mixture of indium oxide In2O3 and tin oxide SnO2). The conductivity of the transparent electrode 14 is low in comparison with that of metal and therefore a narrow width and fine conductive layer is added as the bus electrode on the transparent electrode 14 to enhance its conductivity.

When an address discharge voltage is supplied to the scan electrode and a corresponding address electrode between the barrier ribs 20 (not shown), an address discharge is generated between the scan electrode and the address electrode. An electric field is formed in the interior of a corresponding luminant cell 30, the electrons of the discharge gases are accelerated, and the accelerated electrons collide with ions. At this time, the ionized electrons collide with neutral particles, so that the neutral particles are ionized into electrons and ions at high speed, whereby discharge gas becomes a plasma state, and a vacuum ultraviolet ray is formed.

In a color plasma display panel, ultraviolet rays are converted into light of three primary colors, such as red (R), green (G) and blue (B), by fluorescent layers coated on an inner wall of each luminant cell 30. In order to attain color light emission display, it is important to obtain good white balance characteristic determined by the balance of luminance of the respective three primary colors. In a conventional plasma display, color temperature of white color obtained by simultaneously applying retaining pulses to a red cell, a green cell and a blue cell is approximately about 6500–7500 degrees Kelvin, and is not high enough. With respect to the white balance of this case, white color deviation is approximately 0.01 to 0.015 uv, and especially deviates toward a green color. This is because the dielectric constants of red, green and blue fluorescent substances are different, such that the green fluorescent substance is hard to be driven. In the NTSC system, a higher temperature of 9300 degrees Kelvin is used as a reference white color, as well as a high color temperature is preferred to a low color temperature because of vividness of white color. However, when the color temperature is adjusted to 9300 degrees Kelvin under low color deviation, the number of intensity level of green color will be greatly decreased, even to lower than 200 steps, so that results in a problem of insufficient intensity level numbers.

One way to solve this problem is to change the size of the discharge cells so that intensity of light emission of each color is correspondingly changed, as shown in Japanese patent laid-open publication No. 7-226945. In such an example, when the plasma display panel is driven to display an image, a driving margin to perform a good display as a whole panel decreases.

SUMMARY OF THE INVENTION

It is an object of the present invention to provide a driving electrode structure of a plasma display panel in which a driving electrode is disposed in a hard-driven primary luminant cell such as a green luminant cell to improve the driving characteristic thereof.

It is another object of the present invention to provide a driving electrode structure of a plasma display panel in which display of image produced at high color temperature can be obtained without deterioration of luminous efficiency and drive characteristic.

It is a further object of the present invention to provide a driving electrode structure of a plasma display panel in which the brightness of green color can be depressed by the driving electrode structure so that white color can be balanced with small white color deviation.

It is a yet object of the present invention to provide a driving electrode structure of a plasma display panel in which the number of intensity level of green color can be preserved even at high color temperature with small white color deviation.

In one aspect, the present invention provides a driving electrode structure for a plasma display panel formed on a transparent electrode across a plurality of luminant cells in row. The structure comprises a main electrode located on one side of the transparent electrode adjacent to the edge of the luminant cells, and a driving electrode located in at least one ruminant cell and separated by a distance from the main electrode. The driving electrode has two branches by which the driving electrode is connected to the main electrode.

In another aspect, the present invention provides a driving electrode structure for a plasma display panel formed on a transparent electrode across a plurality of pixels in a row of which each pixel is composed of at least three luminant cells. The structure comprises a driving electrode and a side electrode. The driving electrode is located in one luminant cell of each pixel and separated by a distance from the side of the transparent electrode adjacent to the edge of the luminant cells. The driving electrode has two branches coupled to two ends of the driving electrode. The side electrode is located in other luminant cells of each pixel and on the side of the transparent electrode adjacent to the luminant cells. The side electrode connects the branches in adjacent pixels.

The driving electrode is preferably located in green luminant cells that are hard to be driven such that the driving characteristic of green luminant cells can be improved.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention provides a driving electrode structure of a plasma display panel of which having a driving electrode. The driving electrode is disposed in a hard-driven primary ruminant cell, such as a green luminant cell, to improve the driving characteristic and depress the brightness of green color. The number of intensity level of green color can be preserved event at a high color temperature with small white color deviation.

Figure 1:
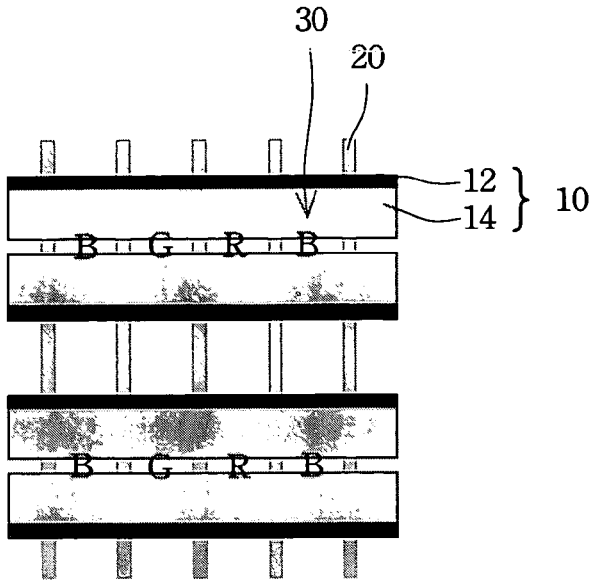
FIG. 1 (PRIOR ART)
FIG. 1 is a schematic plan view of a conventional plasma display panel having a linear bus electrode in accordance with the prior art.
Figure 2:
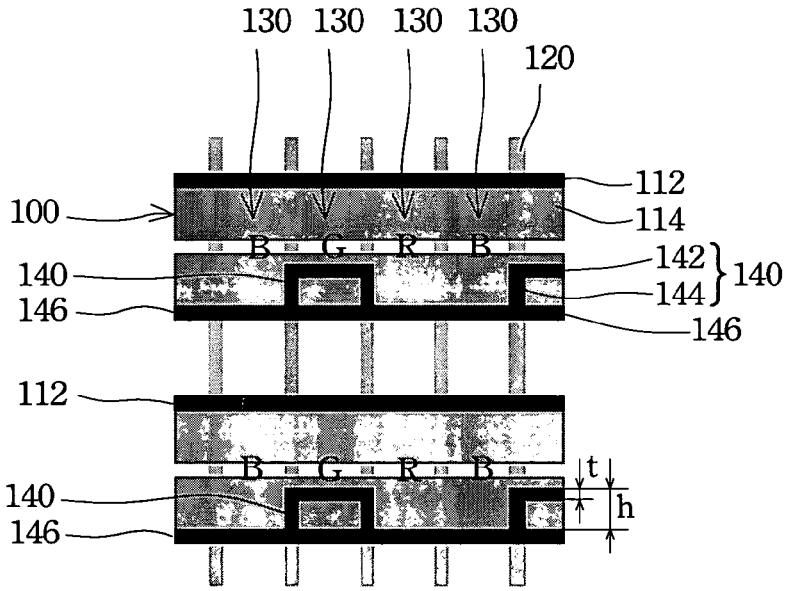
FIG. 2 is a schematic plan view of a plasma display panel having a driving electrode according to one preferred embodiment of the present invention.

FIG. 2 is a schematic plan view of a plasma display panel according to the present invention. The schematic structure is formed between two substrates including a front substrate and a back substrate (not shown). A plurality pair of conductive electrodes 100 is parallel arranged on the rear surface of the front substrate. Each pair of conductive electrodes 100 comprises two transparent electrodes 114. On the back substrate, a plurality of parallel barrier ribs 120 is formed thereon, which are perpendicular to the conductive electrodes 100 to scale a plurality of array luminant cells 130 therebetween. The luminant cells 130 includes at least three primary color luminant cells, for example, a red cell, a green cell and a blue cell, of which adjacent primary color luminant cells constitute a pixel. However, each primary color luminant cell has different driving characteristics because of using different fluorescent layers. If a red cell, a green cell and a blue cell are employed, the green cell is relatively harder to be driven than the red and blue cells. One of the influential factors is the dielectric constant. Moreover, the light emitted from the green cell is brighter than that of the red and blue cells by conventional driving structure with bus electrodes, so that the white balance cannot be obtained because of color deviation.

Referring to FIG. 2 again, a driving electrode structure of the present invention is provided. The driving electrode structure is formed on the transparent electrode 114. In first embodiment, the driving electrode structure includes a main electrode 146 across a plurality of luminant cells 130 in row, and a plurality of driving electrodes 140 coupled to the main electrode 146 and located on each hard-driven luminant cell 130, for example, a green cell. As similar to a conventional bus electrode, the main electrode 146 is located on one side of the transparent electrode 114 adjacent to the edge of the luminant cells 130 in one row. Therefore, the main electrode 146 does not shelter the light emitted from the luminant cells 130. The main electrode 146 is connected to a signal supply circuit (not shown) to control light emission of each luminant cell 130 in this row corresponding with an address electrode between adjacent barrier ribs 120.

In each pixel, a driving electrode 140 is disposed in a hard-driven luminant cell 130, such as a green cell. The driving electrode 140 includes a driving portion 142 and two branches 144 connected the driving portion 142 to the main electrode 146. The driving portion 142 is shifted or separated by a distance h from the main electrode 146 to approximate the discharge center of the luminant cells 130 between a pair of transparent electrodes 114. The distance h may be about 0.2–0.98 times the width of the transparent electrode 114. The width t of the driving portion 142 is adjusted according to the brightness requirement of the ruminant cell 130.

The branches 144 electrically connect the driving portion 142 to the main electrode 146. The branches 144 are perpendicular to the driving portion 142, and are preferably aligned to the barrier ribs 120 to prevent eliminating light emitted from the luminant cells 130. A material of the driving electrode 140 and the main electrode 146 is aluminum, cobalt, silver, molybdenum, chromium, tantalum, tungsten, iron, copper, or an alloy or a combination thereof. The driving electrode 140 and the main electrode 146 are preferably made of a conductive anti-reflective material, such as black silver.

By utilizing the driving electrode 140 of the present invention, the hard-driven luminant cell such as a green cell is readily to be driven, even when the color temperature is increased to as high as 9300 degrees Kelvin. Furthermore, the shifted driving portion 142 depresses the brightness of green cell, such that the white balance of display image can be obtained without requirement of adjusting the output gain of the red, green and blue colors to prevent decreasing the number of intensity level. Therefore, the number of intensity level can be preserved at 256 steps or higher under high color temperature with a small white color deviation. In this embodiment, the driving electrode 140 can be combined with a conventional bus electrode 112.

Figure 3:
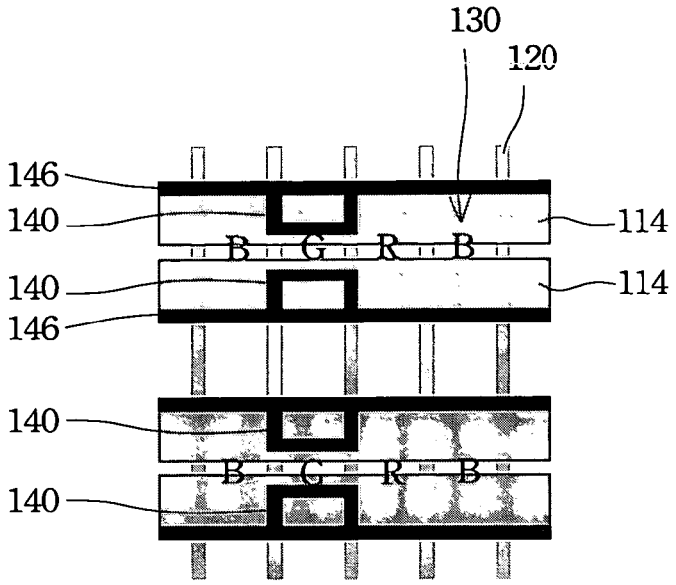
FIG. 3 is a schematic plan view of a plasma display panel having a pair of symmetric driving electrodes according to a modified preferred embodiment of the present invention.
Figure 4:
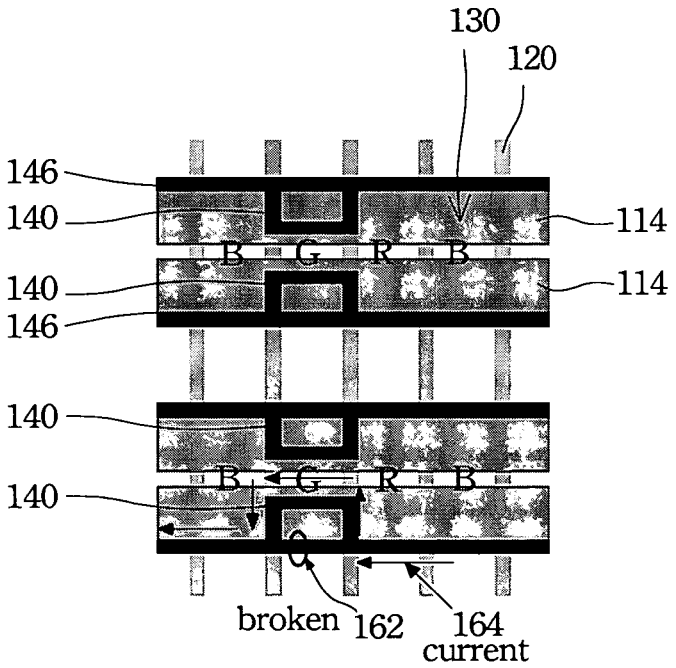
FIG. 4 is a schematic plan view of a plasma display panel illustrated in FIG. 3 that has a line broken at a point of the main electrode parallel to the driving electrode which maintains original function.

Referring to FIG. 3, in a modified embodiment, a pair of symmetric driving electrodes 140 can be formed on the transparent electrodes 114 to obtain more preferable driving characteristics. The opaque driving electrode 140 and main electrode 146 typically have thin widths, such as several to hundreds of microns, because of avoiding a light shield. In the process of fabricating the driving electrode 140 and main electrode 146, the thin opaque conductive line may be broken. If the broken region 162 is located at the luminant cell of which having the driving electrode 140, as shown in FIG. 4, the driving current 164 still flows through the driving electrode 140, so that the operation of the display panel still can be worked. The probability of product failure is thereby reduced.

Figure 5:
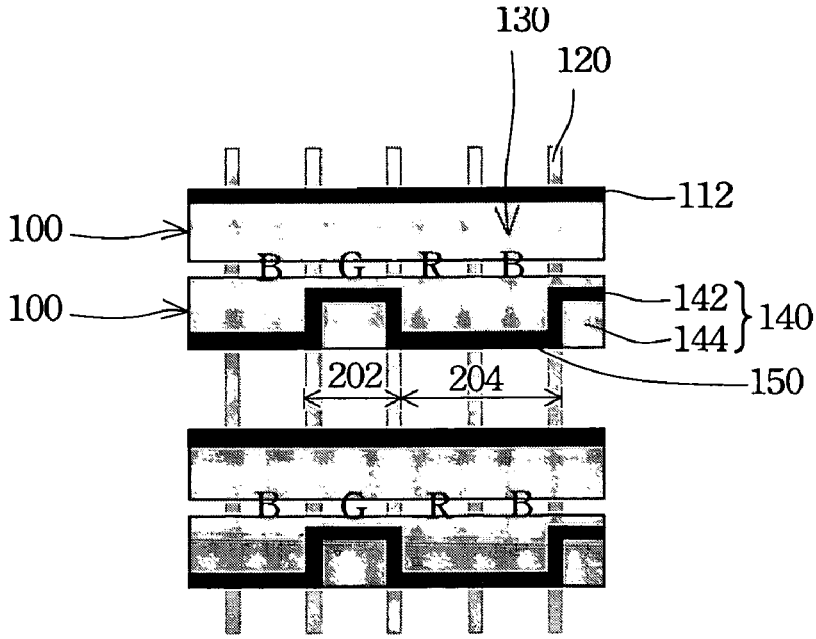
FIG. 5 is a schematic plan view of a plasma display panel having a meandrous driving electrode according to another preferred embodiment of the present invention.

FIG. 5 is a schematic plan view of a plasma display panel according to another preferred embodiment of the present invention. The schematic structure is formed between two substrates including a front substrate and a back substrate (not shown). As above described, a plurality pair of conductive electrodes 100 is parallel arranged on the rear surface of the front substrate. Each pair of conductive electrodes 100 comprises two transparent electrodes 114. On the back substrate, a plurality of parallel barrier ribs 120 is formed thereon, which are perpendicular to the conductive electrodes 100 to scale a plurality of array luminant cells 130 therebetween. The luminant cells 130 include at least three primary color luminant cells, for example, a red cell, a green cell and a blue cell, of which adjacent primary color luminant cells constitute a pixel, in which the green cell is relatively harder to drive than the red and blue cells.

A driving electrode structure is formed on the transparent electrode 114. The driving electrode structure includes a driving electrode 140 and a side electrode 150. The driving electrode 140 and the side electrode 150 are alternately disposed in each pixel of one row. The driving electrode 140 is disposed within hard-driven region 202, i.e. each hard-driven luminant cell 130, such as a green cell. The driving electrode 140 includes a driving portion 142 and two branches 144. The driving portion 142 is shifted or separated by a distance h from one side of the transparent electrode 114 adjacent to the luminant cells 130 in one row to approximate the discharge center of the luminant cells 130 where is between a pair of transparent electrodes 114. The distance h may be about 0.2–0.98 times the width of the transparent electrode 114. The width t of the driving portion 142 is adjusted according to the brightness requirement of the ruminant cell 130. The branches 144 are electrically connected to the driving portion 142. The branches 144 are perpendicular to the driving portion 142, and are preferably aligned to the barrier ribs 120 to prevent eliminating light emitted from the luminant cells 130. The side electrode 150 is located in non-hard-driven region 204, i.e. is located in other luminant cells 130 of each pixel and on the side of the transparent electrode 114 adjacent to the edge of luminant cells 130 in one row. The side electrode 150 is connected to the branches 144 in adjacent pixels. In other words, one end of the side electrode 150 is connected to one branch 144 in the same pixel, and the other end of the side electrode 150 is connected to another branches 144 in adjacent pixel. Therefore, a meandrous electrode is formed. A material of the driving electrode 140 and the side electrode 150 is consisting of aluminum, cobalt, silver, molybdenum, chromium, tantalum, tungsten, iron, copper, or an alloy or a combination thereof. The driving electrode 140 and the side electrode 150 are preferably made of a conductive anti-reflective material. Regarding to other detail description is referred to foregoing embodiment.

Figure 6:
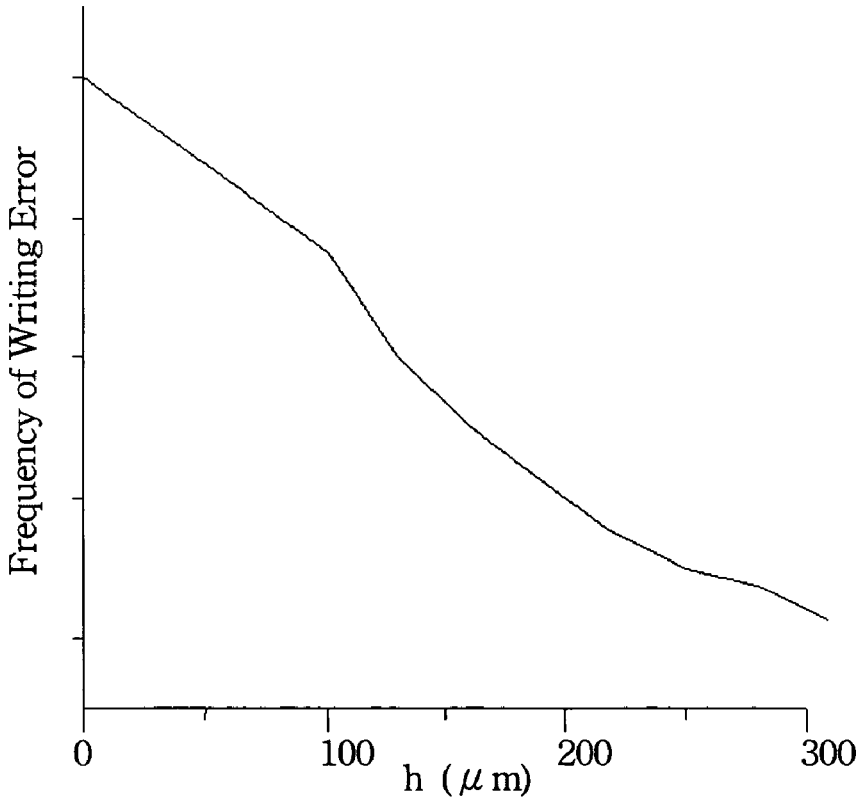
FIG. 6 is a diagram illustrated the frequency of writing error corresponding to the position of the driving electrode of the present invention.

Referring to FIG. 6, the advantages of the driving electrode 140 will be more readily understood by in conjunction with the drawing. FIG. 6 is a diagram illustrated the frequency of writing error corresponding to the position of the driving portion 142. The frequency of writing error is relatively high as well as the shifted distance h is small. When the distance h is increased, the frequency of writing error is correspondingly decreased. Therefore, the driving characteristic of hard-driven luminant cell can be improved.

According to above description, the present invention provides a driving electrode structure of a plasma display panel of which having a driving electrode. The driving electrode structure can improve the driving characteristic of a hard-driven luminant cell. The white color deviation is reduced by depressing the high brightness of luminant cell. Moreover, the number of intensity level of hard-driven luminant cell can be preserved even at high color temperature with small white color deviation.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A driving electrode structure for a plasma display panel formed on a transparent electrode across a plurality of pixels in a row, wherein each of the pixels is composed of at least three luminant cells, the driving electrode structure comprising:

a main electrode located on one side of the transparent electrode adjacent to an edge of the luminant cells; and a driving electrode located in a portion of the luminant cells, which is harder to be driven than the rest of the luminant cells, in each pixel, and separated by a distance of about 0.2–0.98 times a width of the transparent electrode from the main electrode, the driving electrode having two branches connecting the driving electrode to the main electrode, whereby a white color at a desired color temperature can be obtained for each of the pixels.

2. The structure according to claim 1, wherein a material of the main electrode and the driving electrode is selected from a group consisting of aluminum, cobalt, silver, molybdenum, chromium, tantalum, tungsten, iron, copper and a combination thereof.

3. The structure according to claim 1, wherein the driving electrode approximates a discharge center of the luminant cells.

4. The structure according to claim 1, wherein the portion of the luminant cells, being harder to be driven, comprises a green luminant cell.

5. The structure according to claim 1, wherein the two branches are located above barrier ribs of a plasma display panel to maximize light-emitting area of the luminant cells having the driving electrodes.

6. A driving electrode structure for a plasma display panel formed on a transparent electrode across a plurality of pixels in a row, wherein each pixel is composed of at least three luminant cells, the driving electrode structure comprising:

a driving electrode located in a portion of the luminant cells, which is harder to be driven than the rest of the luminant cells, in each pixel and separated by a distance of about 0.2–0.98 times a width of the transparent electrode from one side of the transparent electrode adjacent to an edge of the luminant cells, the driving electrode having two branches coupled to two ends of the driving electrode and extending to the side of the transparent electrode; and a side electrode located between the branches in the rest of the luminant cells of each pixel and on the side of the transparent electrode adjacent to the edge of luminant cells, the side electrode connecting the branches, whereby a white color at a desired color temperature can be obtained for each of the pixels.

7. The structure according to claim 6, wherein a material of the driving electrode and the side electrode is selected from a group consisting of aluminum, cobalt, silver, molybdenum, chromium, tantalum, tungsten, iron, copper and a combination thereof.

8. The structure according to claim 6, wherein the driving electrode approximates a discharge center of the luminant cells.

9. The structure according to claim 6 wherein the portion of the luminant cells, being harder to be driven, comprises a green luminant cell.

10. The structure according to claim 6 wherein the two branches are located above barrier ribs of a plasma display panel to maximize light-emitting area of the luminant cells having the driving electrodes.

* * * * *